US007373985B2

(12) United States Patent
Moe

(10) Patent No.: US 7,373,985 B2
(45) Date of Patent: May 20, 2008

(54) TWO-PART TELESCOPIC TENSIONER FOR RISERS AT A FLOATING INSTALLATION FOR OIL AND GAS PRODUCTION

(75) Inventor: Magne Mathias Moe, Harstad (NO)

(73) Assignee: National Oilwell Norway AS (NO)

( * ) Notice: Subject to any disclaimer, the term of this patent is extended or adjusted under 35 U.S.C. 154(b) by 60 days.

(21) Appl. No.: 10/534,683

(22) PCT Filed: Nov. 10, 2003

(86) PCT No.: PCT/NO03/00377

§ 371 (c)(1),
(2), (4) Date: Oct. 5, 2005

(87) PCT Pub. No.: WO2004/044374

PCT Pub. Date: May 27, 2004

(65) Prior Publication Data

US 2006/0151176 A1 Jul. 13, 2006

(30) Foreign Application Priority Data

Nov. 12, 2002 (NO) ..... 20025409

(51) Int. Cl.
*E21B 29/12* (2006.01)

(52) U.S. Cl. ..... 166/355; 166/352; 166/364; 405/224.4

(58) Field of Classification Search ..... 166/355, 166/350, 352, 354, 364; 405/224.4
See application file for complete search history.

(56) References Cited

U.S. PATENT DOCUMENTS

| | | | | |
|---|---|---|---|---|
| 4,712,620 | A | 12/1987 | Lim et al. | |
| 4,808,035 | A * | 2/1989 | Stanton et al. | 405/224.4 |
| 5,069,488 | A * | 12/1991 | Freyer et al. | 285/302 |
| 5,794,700 | A * | 8/1998 | Pollack | 166/339 |
| 5,846,028 | A * | 12/1998 | Thory | 405/195.1 |
| 6,000,480 | A | 12/1999 | Eik | |
| 6,530,430 | B2 * | 3/2003 | Reynolds | 166/346 |
| 6,691,784 | B1 * | 2/2004 | Wanvik | 166/355 |
| 7,191,837 | B2 * | 3/2007 | Coles | 166/355 |
| 7,219,739 | B2 * | 5/2007 | Robichaux | 166/355 |
| 7,231,981 | B2 * | 6/2007 | Moe et al. | 166/355 |
| 2002/0000321 | A1 | 1/2002 | Reynolds | |
| 2004/0099421 | A1 * | 5/2004 | Trewhella | 166/355 |
| 2006/0016605 | A1 * | 1/2006 | Coles | 166/355 |
| 2006/0180314 | A1 * | 8/2006 | Williams | 166/355 |

FOREIGN PATENT DOCUMENTS

| | | |
|---|---|---|
| EP | 1 103 459 | 5/2001 |
| GB | 2 358 032 | 7/2001 |
| NO | 309290 | 1/2001 |

* cited by examiner

*Primary Examiner*—Thomas A Beach
(74) *Attorney, Agent, or Firm*—Andrus, Sceales, Starke & Sawall, LLP

(57) ABSTRACT

A tensioning device (15) for a riser (5) connecting a subsea borehole (7) with a floating installation (1) on the surface of the sea (11), where the tensioning device (15) is provided with telescoping tubes (27, 27') and also several evenly spaced hydraulic cylinders (31, 31') arranged in a peripherally encircling manner and mainly in the longitudinal direction of the riser, and where the tension in the riser is exerted through hydraulic pressure in said cylinder (31, 31'), the tensioning device (15) consisting of two successive, interconnected telescopic tensioning units (23, 25), the tensioning units (23, 25) being designed separately to maintain a prescribed tension in the riser (5).

5 Claims, 2 Drawing Sheets

TWO-PART TELESCOPIC TENSIONER FOR RISERS AT A FLOATING INSTALLATION FOR OIL AND GAS PRODUCTION

CROSS REFERENCE TO RELATED APPLICATION

The present application is the U.S. national stage application of International Application PCT/NO2003/000377, filed Nov. 10, 2003, which international application was published on May 27, 2004 as International Publication WO 2004/044374. The International Application claims priority of Norwegian Patent Application 20025409, filed Nov. 12, 2002.

BACKGROUND OF THE INVENTION

This invention regards a two-part telescopic tensioner for connection to a riser extending between a borehole and a floating installation on a subsea oil or gas field, where the purpose of the tensioner is to maintain tension in the riser, partly through taking up the rapid vertical movements of the floating installation, and partly through compensating for the slow changes in difference in level between the top of the borehole with its seabed installation, and the floating installation.

Waves and wind cause rapid changes in the level difference between the seabed and the floating installation used for offshore exploration or production of hydrocarbons.

Slow changes are caused by tidal changes, changes in the load on the installation, trimming of the installation for adjustment of freeboard according to forecast changes in the weather and in the event of horizontal drift.

The main function of a telescopic riser unit is to ensure that the upper part of the riser is able to telescope without any leakage of the liquids and/or gases that are being conveyed through the pipe. The telescopic unit may co-operate with a separate system for riser tensioning, or the telescopic unit may comprise integrated hydraulic cylinders that through co-operation with pumps and accumulators ensure that the required tension is maintained in the riser.

In waters having great tidal variations and/or a large design wave height, the telescopic units used today have a length of stroke of up to 70 feet (21,34 metres).

The use of single telescopic units dimensioned to accommodate both rapid and slow predictable variations has several disadvantages. It leads to a) movement of an unnecessarily large dynamic mass;

b) wear and tear and a requirement for maintenance on large units; and c) a requirement for several sizes.

SUMMARY OF THE INVENTION

The object of the invention is to remedy the disadvantages of prior art.

The object is achieved by the characteristics stated in the description below and in the following claims.

Two standard telescopic units, preferably having different lengths, e.g. 40 and 25 feet (12,19 and 7,62 metres), are connected. This two-part telescopic unit is then coupled to an upper end of a riser extending vertically from a borehole on the seabed to a floating oil installation, by use of techniques that are known per se, and a flexible joint on a lower portion of a riser extension that extends above a drill floor on said floating installation via a manifold.

Through techniques that are known per se, the telescopic unit is provided with two tubes at its centre, which tubes telescope inside each other and have dimensions that correspond to the dimension of the riser. The telescopic unit is provided with suitable packings according to prior art, which packings ensure that any leakage of the liquid or gas flowing through the riser is, under the circumstances, kept at an acceptable level.

Each telescopic unit is equipped with several evenly spaced hydraulic cylinders arranged in a peripherally encircling manner and mainly in the longitudinal direction of the telescopic unit, all according to art that is known per se.

The two telescopic units are connected separately to a hydraulic system that is known per se, having an associated control system which according to the invention is designed to maintain a predetermined tension in the riser, the length of one or both of the telescopic units being adjusted in time with the variations in the height of the floating installation above the seabed.

When the tension in the riser needs to be adjusted to compensate for rapid movements in the floating installation, use is preferably made of the upper telescopic unit. This allows the advantage of moving the smallest possible mass, as only the overhead riser extension is moved with the upper telescopic unit.

When the required adjustments in tension are due to slow changes in the level of the floating installation relative to the seabed, e.g. due to tidal changes or an increase in the stability of a platform in anticipation of big waves, by lowering it deeper into the sea, the lower telescopic unit is adjusted.

In a situation where the upper telescopic unit is not functioning, the two-part riser tensioner of the invention will, within certain limits, be able to maintain the correct tension in the riser by the control system being reset so as to make the lower telescopic unit compensate for the rapid changes in level of the floating installation.

BRIEF DESCRIPTION OF THE DRAWINGS

In the following, a description is given of a non-limiting example of a preferred embodiment illustrated in the accompanying drawings, in which.

DETAILED DESCRIPTION OF THE INVENTION

Figure 1:
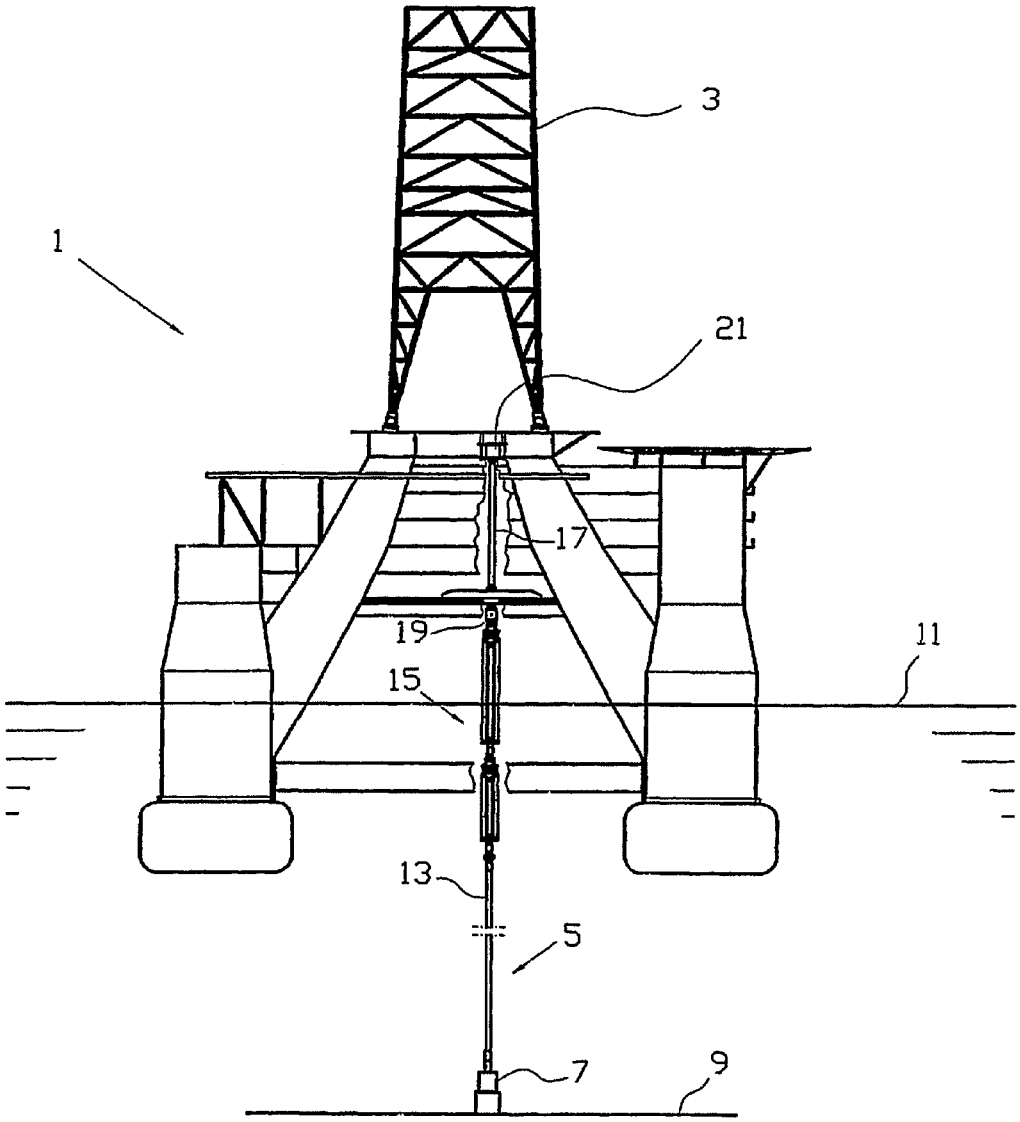
FIG. 1 shows a drilling platform connected to a well by a riser comprising a two-part riser tensioner.
Figure 2A:
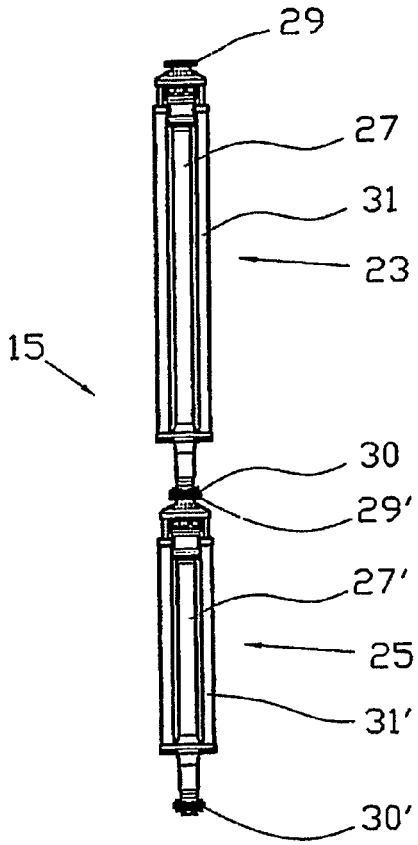
FIG. 2*a* shows a two-part riser tensioner in the contracted position, on a larger scale.
Figure 2B:
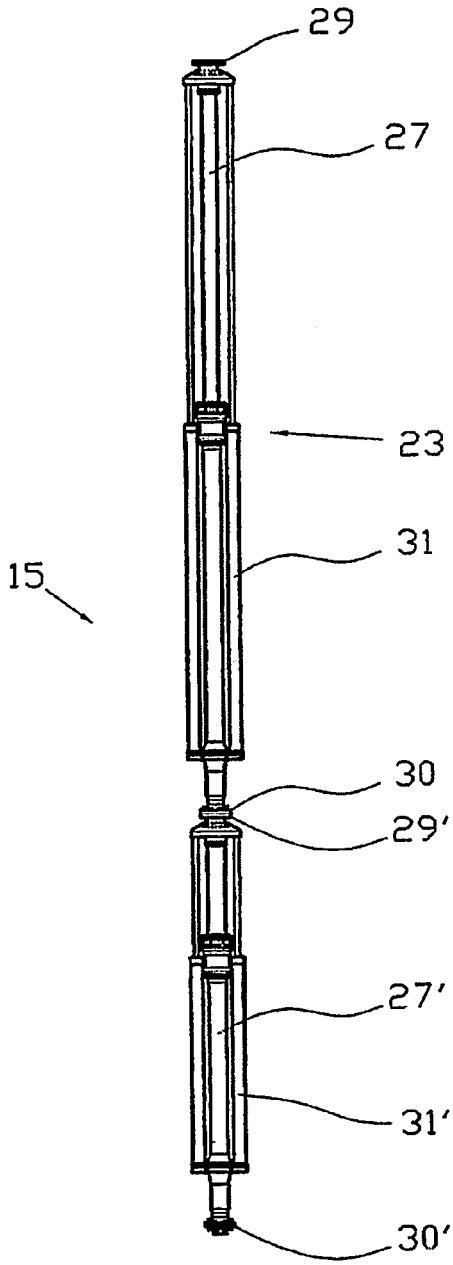
FIG. 2*b* shows a two-part riser tensioner in the extended position, on the same scale.

In the drawings, reference number 1 denotes a floating drilling platform with a derrick 3. A riser 5 extends from a borehole installation 7 on the seabed 9 towards the drilling platform, which floats on the surface of the sea 11.

The riser 5 comprises an upper section 13 with a tensioning device 15. A riser extension 17 comprises a joint 19 and a manifold 21.

The tensioning device 15 comprises an upper telescopic unit 23 and a lower telescopic unit 25. Each telescopic unit 23, 25 comprises a telescopic tube 27, 27' with associated flanges 29, 29', 30, 30' for coupling to the riser 5 adjacent to the respective telescopic unit, riser joint 19 and/or the telescopic unit 23, 25.

Each telescopic unit 23, 25 is provided with several evenly spaced hydraulic cylinders 31, 31' arranged in a peripherally encircling manner and mainly in the longitudinal direction of the telescopic unit 23, 25.

The telescopic units 23, 25 are separately connected to a hydraulic system (not shown) comprising pumps, control devices and an oil reservoir.

The rapid vertical movements of the floating installation 1 caused by waves or other influences are normally compensated through hydraulic adjustment of the upper tensioning unit 23. The lower tensioning unit 25 is not adjusted. This maintains a prescribed tension in the riser 5 through movement of only a part of the tensioning device 15. Thus both the dynamic forces acting on the equipment, the power consumption and the wear and tear on the equipment are reduced.

Slow, predictable vertical movements (tidal changes, trimming of the deepdraught of the floating installation etc.) are compensated for through adjusting the lower tensioning unit 25.

In a situation where one of the tensioning units 23, 25 is out of operation (damage or maintenance) the other tensioning unit may be used to compensate for both rapid and slow changes in the vertical position of the floating installation 1 relative to the seabed 9.

The invention claimed is:

1. An arrangement for tensioning a riser, the arrangement comprising:

a riser having a lower end positioned towards a sub-sea borehole and an upper end positioned towards a floating installation on the surface of the sea; and upper and lower telescopic tensioning units that are integrated into the riser and that are successively interconnected to each other, the upper and lower telescopic tensioning units operating separately to maintain a prescribed tension in the riser;

wherein the upper and lower telescopic tensioning units each comprise a telescopic tube and a plurality of evenly spaced hydraulic cylinders arranged in a peripherally encircling manner around the tube and mainly in the longitudinal direction of the telescopic unit.

2. The tensioning device of claim 1, wherein each of the upper and lower telescopic tensioning units are separately connected to a hydraulic system to facilitate the separate operation of the upper and lower telescopic tensioning units.

3. The tensioning device of claim 2, wherein rapid changes in the vertical position of the floating installation relative to the seabed are compensated for by the upper telescopic tensioning unit and slower changes in the vertical position of the floating installation relative to the seabed are compensated for by the lower telescopic tensioning unit.

4. The tensioning device of claim 3, wherein one of the upper and lower telescopic tensioning units alone maintains the prescribed tension in the riser in a situation wherein the other one of the upper and lower telescopic tensioning units is out of operation.

5. The tensioning device of claim 1, wherein the lower telescopic tensioning unit has a lower end connected to the riser and an upper end connected to a lower end of the upper telescopic tensioning unit, and wherein the upper telescopic tensioning unit has an upper end connected to at least one of the riser and the floating installation.

* * * * *